US008969697B2

(12) United States Patent
Hamilton, II

(10) Patent No.: US 8,969,697 B2
(45) Date of Patent: Mar. 3, 2015

(54) HEEL DRIVEN PEDAL APPARATUS

(71) Applicant: David Lee Hamilton, II, Chatsworth, GA (US)

(72) Inventor: David Lee Hamilton, II, Chatsworth, GA (US)

( * ) Notice: Subject to any disclaimer, the term of this patent is extended or adjusted under 35 U.S.C. 154(b) by 0 days.

(21) Appl. No.: 14/146,352

(22) Filed: Jan. 2, 2014

(65) Prior Publication Data

US 2015/0020675 A1 Jan. 22, 2015

Related U.S. Application Data

(60) Provisional application No. 61/856,325, filed on Jul. 19, 2013.

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
See application file for complete search history.

(56) References Cited

U.S. PATENT DOCUMENTS

| | | | | | |
|---|---|---|---|---|---|
| 800,509 | A * | 9/1905 | Stanton | 84/422.1 |
| 2,484,302 | A * | 10/1949 | Laverents | 84/422.1 |
| 2,672,784 | A * | 3/1954 | Sabo | 84/422.1 |
| 3,618,441 | A * | 11/1971 | Fearns | 84/422.1 |
| 4,134,325 | A * | 1/1979 | Loftus | 84/422.1 |
| 5,355,761 | A * | 10/1994 | Ward et al. | 84/422.2 |
| 5,458,039 | A * | 10/1995 | Ashby | 84/422.1 |
| 5,866,830 | A * | 2/1999 | Onyszkanycz | 84/422.1 |
| 6,002,076 | A * | 12/1999 | Karn | 84/422.1 |
| 6,271,450 | B1 * | 8/2001 | Mackie | 84/422.1 |
| 6,541,686 | B2 * | 4/2003 | O'Donnell | 84/422.1 |
| 8,546,676 | B2 * | 10/2013 | Hashimoto | 84/721 |
| 2012/0152085 | A1 * | 6/2012 | Gordon, Sr. | 84/422.1 |
| 2012/0174734 | A1 * | 7/2012 | Dorfman et al. | 84/422.1 |

* cited by examiner

*Primary Examiner* — Robert W Horn
(74) *Attorney, Agent, or Firm* — Dale J. Ream

(57) ABSTRACT

A heel driven pedal apparatus includes a base member and a footboard pivotally coupled to the base member. The footboard is pivotally movable between a released configuration at which the rear end is displaced from the base member and a compressed configuration at which the rear end is adjacent the base member. A spindle shaft includes a proximal end operatively coupled to the front end of the footboard with a linkage assembly, and an opposed distal end. A beater head is coupled to the distal end of the spindle shaft, the linkage assembly and the spindle shaft being configured to move the beater head toward a percussion instrument when the footboard is moved toward the compressed configuration and away from the percussion instrument when the footboard is moved toward the released configuration. The beater head is rotatable to position a desired beater head surface for contact with the percussion instrument.

23 Claims, 6 Drawing Sheets

HEEL DRIVEN PEDAL APPARATUS

REFERENCE TO RELATED APPLICATIONS

This non-provisional patent application claims the benefit of provisional application Ser. No. 61/856,325 filed on Jul. 19, 2013, titled Heel Driven Pedal.

BACKGROUND OF THE INVENTION

This invention relates to musical devices and, more particularly, to a foot pedal device for use by a musician while playing a percussion instrument.

During the course of playing the drums and other percussion instruments, a musician may be required to use a foot to operate one or more pedals. Existing foot pedals are operated with the toe end of a musician's foot. Operating a foot pedal with the toe end of a foot requires use of the foot and ankle muscles. This makes playing or operating the pedal more difficult and harder to learn than if the pedal could be operated with the larger leg muscles. A heel driven foot pedal allows a musician to operate the foot pedal with the heel end of his or her foot. Operating a foot pedal with the heel end of a foot allows the musician to use his or her larger leg muscles.

Therefore, it would be desirable to have a heel driven pedal apparatus that can be operated with the heel end of a musician's foot. Further, it would be desirable to have a heel driven pedal apparatus that can also be operated with the toe portion of the musician's foot so that the musician can rest his or her leg muscles by switching from heel end operation to toe end operation without requiring any changes to the heel driven pedal apparatus.

SUMMARY OF THE INVENTION

A heel driven pedal apparatus for operation by a musician's foot while playing a percussion instrument according to the present invention includes a base member. A footboard includes a front end, an opposed rear end, and opposed first and second side edges extending between the front end and the rear end. The first and second side edges are pivotally coupled to the base member at a point displaced from both the front end and the rear end such that the footboard is pivotally movable between a released configuration at which the rear end is displaced from the base member and a compressed configuration at which the rear end is adjacent the base member.

A spindle shaft includes a proximal end operatively coupled to the front end of the footboard with a linkage assembly, and an opposed distal end. A beater head is coupled to the distal end of the spindle shaft. The linkage assembly and spindle shaft are configured to move the beater head towards the percussion instrument when the footboard is moved towards the compressed configuration and away from the percussion instrument when the footboard is moved towards the released configuration. The beater head may be selectively rotated on the spindle shaft to selectively position a desired beater head surface for contact with the percussion instrument.

Therefore, a general object of this invention is to provide a heel driven pedal apparatus useful by a musician while playing a percussion instrument.

Another object of this invention is to provide a heel driven pedal apparatus, as aforesaid, that may be operated by either the heel end or the toe end of a musician's foot.

Still another object of this invention is to provide a heel driven pedal apparatus, as aforesaid, that utilizes a linkage assembly to move a beater head relative to a percussion instrument in correlation with the movement of a footboard.

Yet another object of this invention is to provide a heel driven pedal apparatus, as aforesaid, that utilizes a spring assembly to urge a footboard towards a released configuration.

A further object of this invention is to provide a heel driven pedal apparatus, as aforesaid, that includes a beater head that is axially rotatable about the spindle shaft and includes multiple beater surfaces that cause respective sounds when struck against the percussion instrument.

A still further object of this invention is to provide a heel driven pedal apparatus, as aforesaid, that is easy to use and inexpensive to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
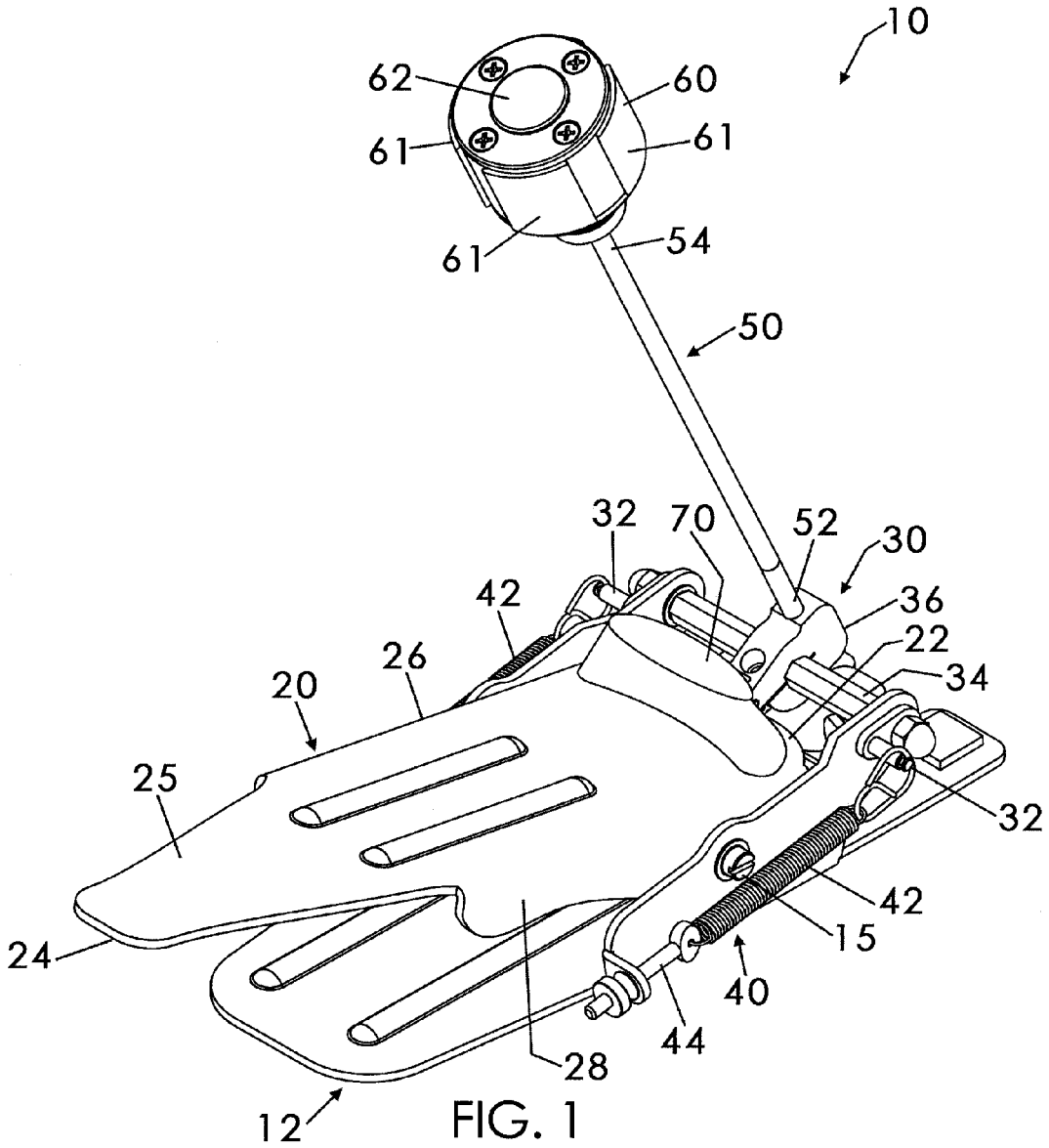
FIG. 1 is a perspective view of the heel driven pedal apparatus illustrating the footboard in a released configuration.

A heel driven pedal apparatus according to a preferred embodiment of the present invention will now be described with reference to FIGS. 1 to 4 of the accompanying drawings. The heel driven pedal apparatus 10 includes a base member 12, a footboard 20, a linkage assembly 30, a spindle shaft 50, and a beater head 60. The heel driven pedal apparatus 10 may also include a spring assembly 40.

The footboard 20 includes a front end 22 and an opposed rear end 24. At least one pivot member 15 may pivotally couple the footboard 20 to the base member 12. The pivot member 15 is displaced from, and aft of, the front end 22 of the footboard 20 and is displaced from, and forward of, the rear end 24 of the footboard 20.

The footboard 20 may also include opposed first 26 and second 28 side edges. The first 26 and second 28 side edges may extend between the front 22 and rear 24 ends of the footboard 20. The footboard 20 may be pivotally coupled to the base member 12 at the first 26 and second 28 side edges of the footboard 20 between the front 22 and rear 24 ends of the footboard 20. The footboard 20 is pivotally coupled at a location that is displaced from both the front 22 and the rear 24 ends of the footboard 20.

Figure 2:
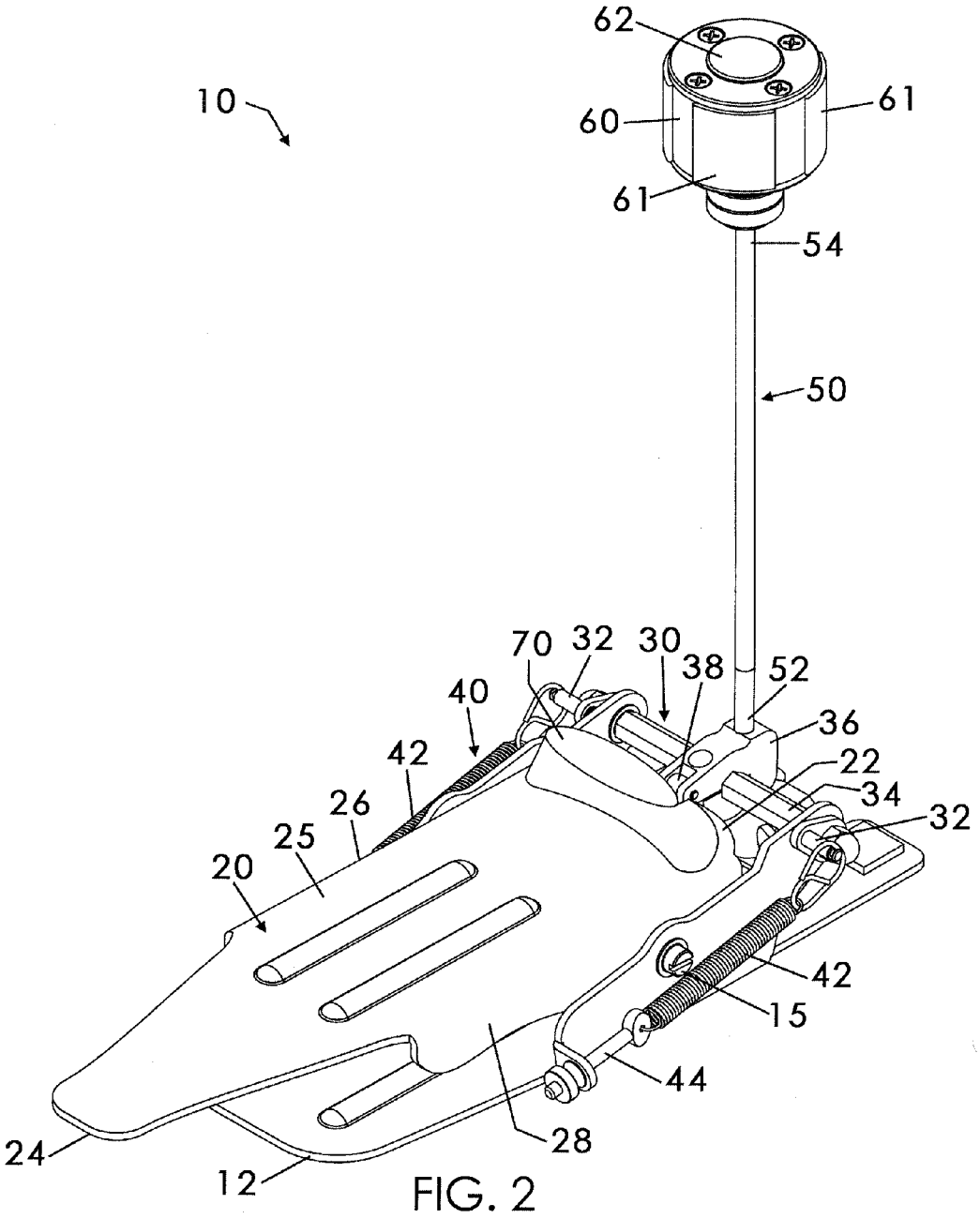
FIG. 2 is a perspective view of the heel driven pedal apparatus, as in FIG. 1, illustrating the footboard in a compressed configuration.
Figure 3:
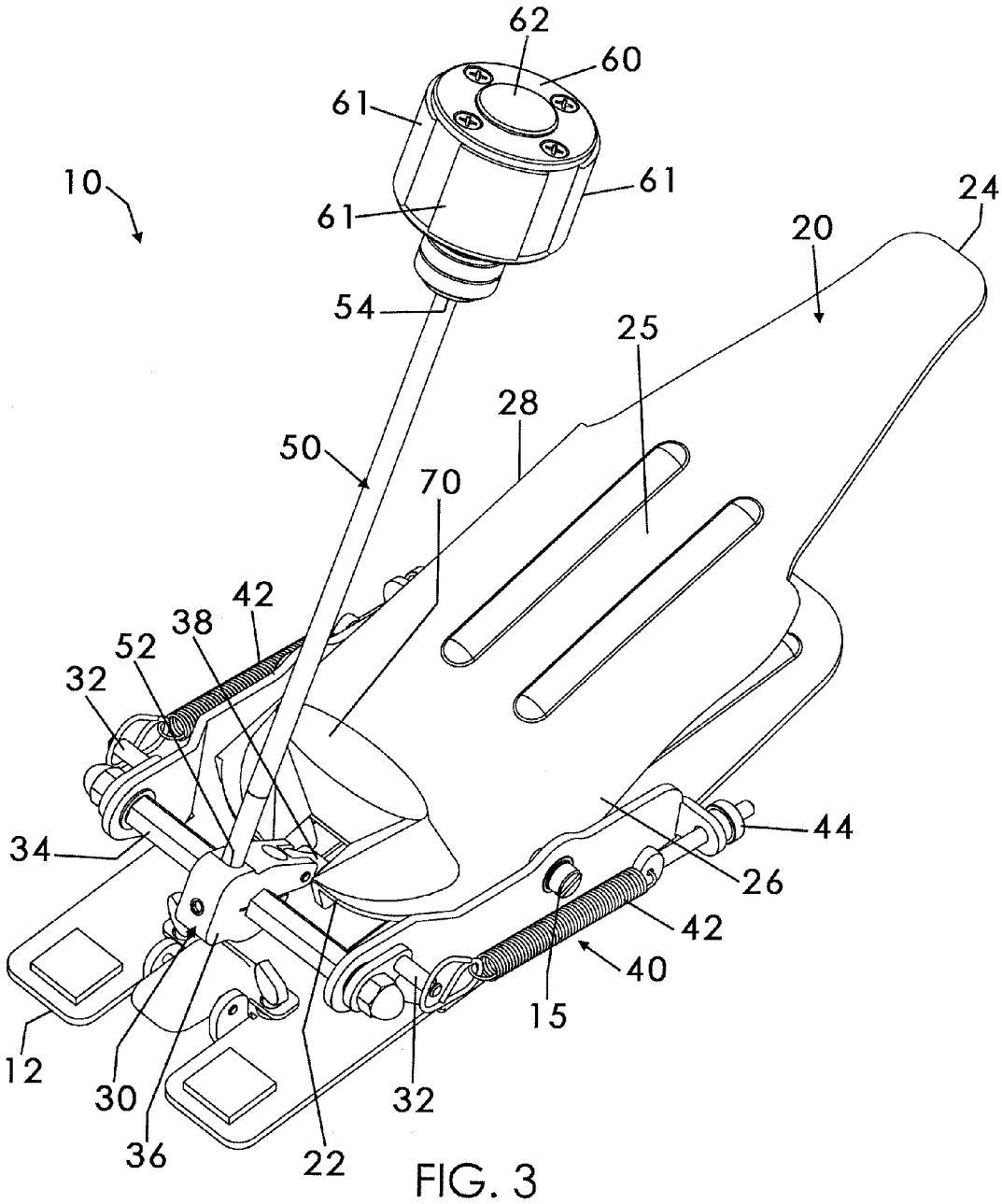
FIG. 3 is a perspective view of the heel driven pedal apparatus, taken from a different angle as FIG. 1, illustrating the footboard in a released configuration.
Figure 4:
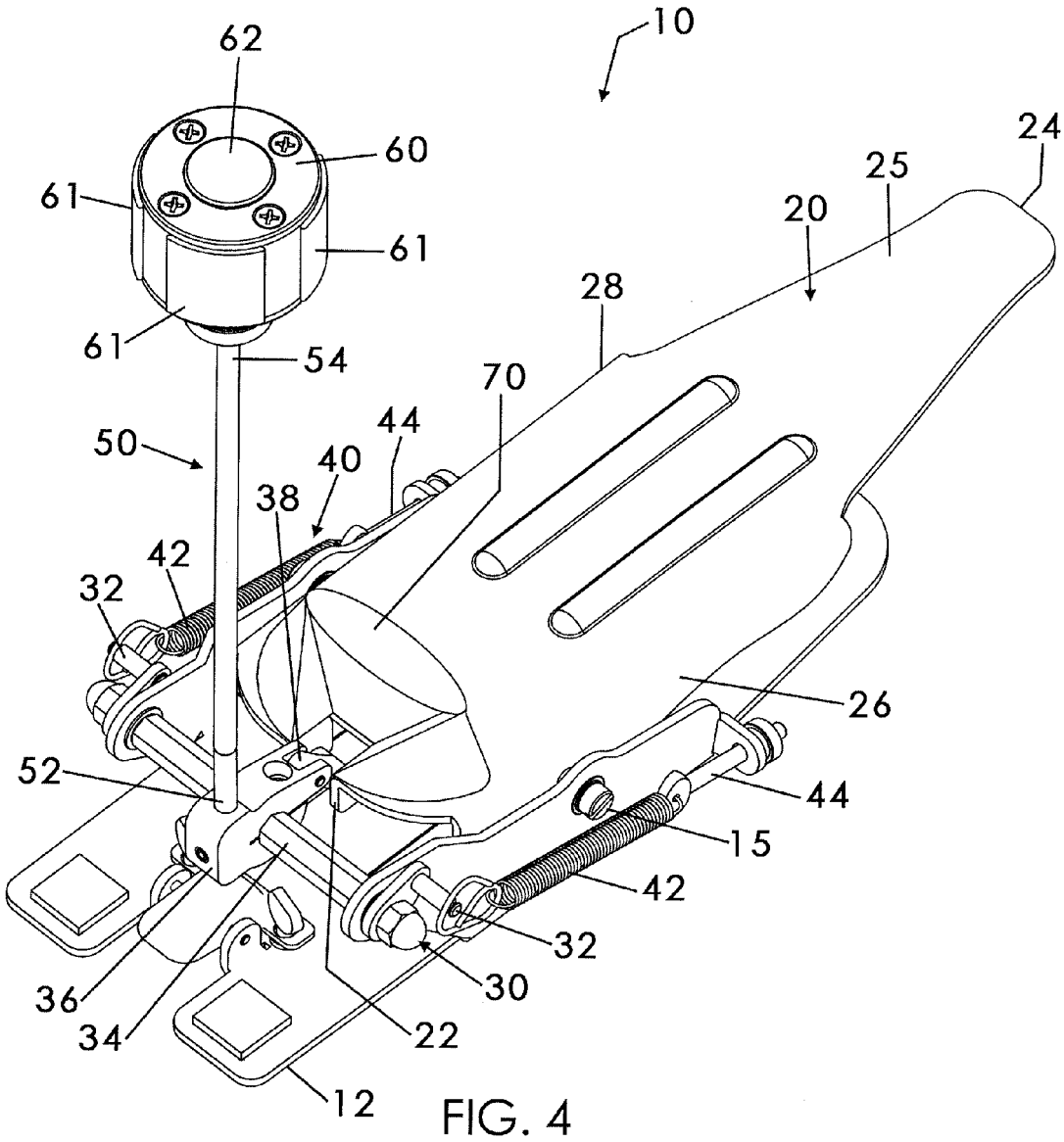
FIG. 4 is a perspective view of the heel driven pedal apparatus, as in FIG. 3, illustrating the footboard in a compressed configuration.

The footboard 20 is pivotally movable between a released configuration (FIG. 1) and a compressed configuration (FIG. 2). In the released configuration, the rear end 24 of the footboard 20 is displaced from the base member 12. In the compressed configuration, the rear end 24 of the footboard 20 is adjacent to the base member 12.

The footboard 20 may include a planar surface 25 that spans between opposed front 22 and rear 24 ends and opposed first 26 and second 28 side edges of the footboard 20. The planar surface 25 of the footboard 20 may be configured to selectively support a musician's foot between the front 22 and rear 24 ends of the footboard 20 such that the footboard 20 may be driven by a heel portion of the musician's foot. A toe plate 70 may be coupled to the front end 22 of the footboard 20 so as to prevent the musician's foot from extending beyond the front end 22 of the footboard 20 and/or to ensure that the musician's heel is positioned behind the pivot member 15. The planar surface 25 of the footboard 20 may also be configured to allow the musician to locate his or her foot behind the pivot member 15 such that the footboard 20 may be driven by a toe portion of the musician's foot.

The spindle shaft 50 has a proximal end 52 and an opposed distal end 54. The beater head 60 is coupled to the distal end 54 of the spindle shaft 50 and the proximal end 52 of the spindle shaft 50 is coupled to the linkage assembly 30. The linkage assembly 30 is coupled to the front end 22 of the footboard 20.

In one embodiment, the linkage assembly 30 and the spindle shaft 50 may be configured to move the beater head 60 relative to the footboard 20, and vice versa. As the footboard 20 is moved towards the compressed configuration, the linkage assembly 30 and the spindle shaft 50 may move the beater head 60 towards the percussion instrument. As the beater head 60 moves away from the percussion instrument, the spindle shaft 50 and the linkage assembly 30 may move the footboard 20 towards the released configuration.

In the same embodiment, or in a different embodiment, the linkage assembly 30 may be configured to move the spindle shaft 50 and the beater head 60 relative to the footboard 20. More particularly, the linkage assembly 30 may be configured to move the spindle shaft 50 and the beater head 60 away from the front end 22 of the footboard 20 when the footboard 20 is moved toward the compressed configuration. The linkage assembly 30 may also be configured to move the spindle shaft 50 and the beater head 60 towards the front end 22 of the footboard 20 when the footboard 20 is moved toward the released configuration.

In one embodiment, the beater head 60 may be axially coupled to the distal end 54 of the spindle shaft 50. The beater head 60 may include multiple spaced apart beater surfaces 61, each causing a unique sound when contacted against the percussion instrument such as against the face of a drum. More particularly, the beater head 60 may be coupled to the spindle shaft 50 such that the beater head 60 or release is first pushed downward and then rotated until a desired beater head surface 61 is selected and positioned as desired and then released whereby a spring urges the beater head upward back into a locked position.

Figure 5:
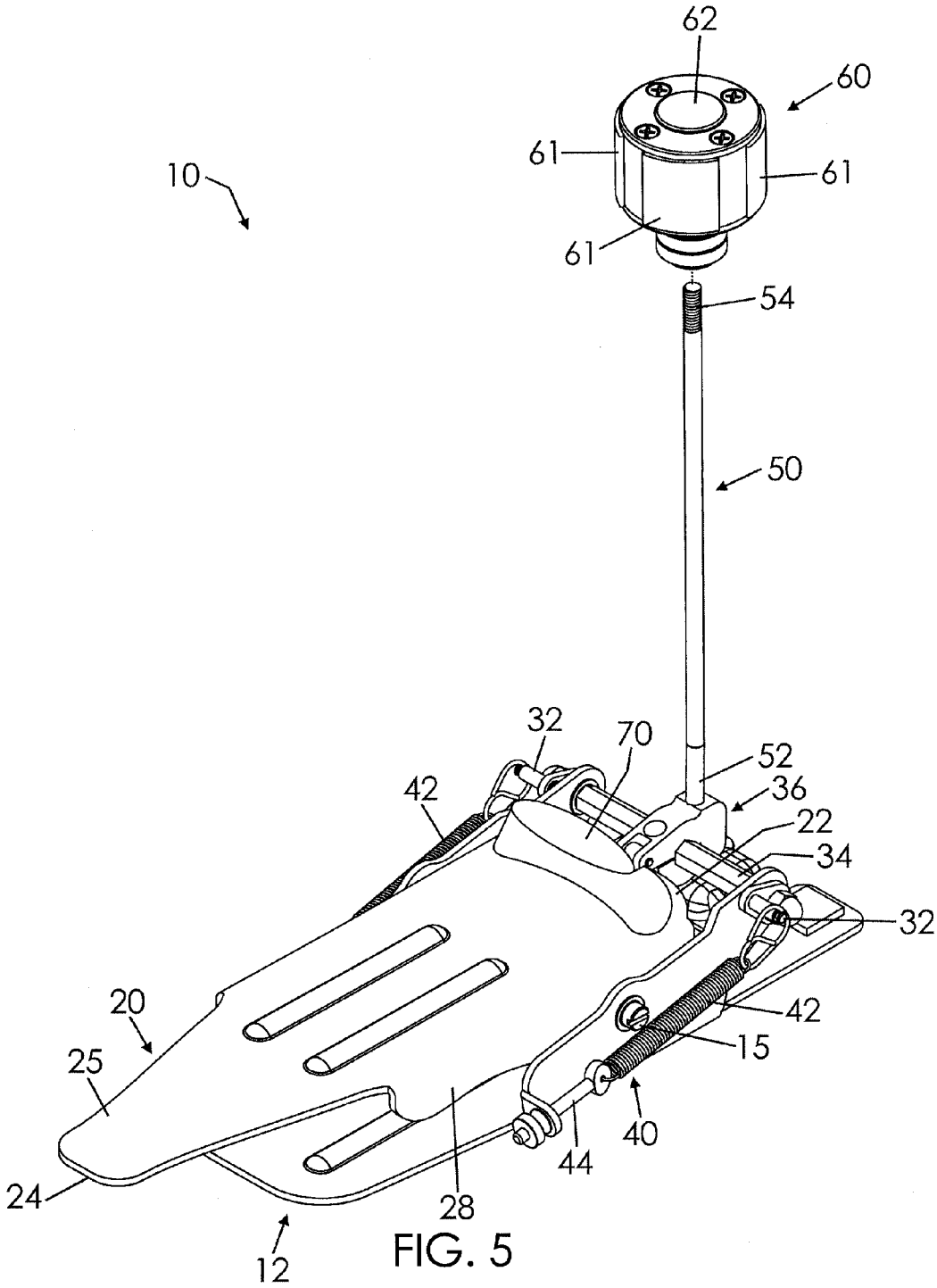
FIG. 5 is a perspective view of the heel driven pedal apparatus as in FIG. 1 with the beater head removed from the spindle shaft.

In the same or another embodiment, the beater head 60 may be removably coupled to the distal end 54 of the spindle shaft 50 (FIG. 5). The interchangeable beater head surfaces 61 may be selected by depressing a spring biased beater head body portion 62 towards the spindle shaft 50 while simultaneously twisting the beater head 60 relative to the spindle shaft 50. The interchangeable beater head surfaces 61 may then be selected or interchanged with another beater head surface 61. Still another beater head surface 61 may be selected by twisting the beater head 60 relative to the spindle shaft 50, and so on. The interchangeable beater head surfaces 61 may be the same size, type, and style as a previously selected beater head surfaces 61, or it may be a different size, type, or style so as to create a different sound than the sound created by the old beater head surface 61 when it strikes a percussion instrument.

Figure 6:
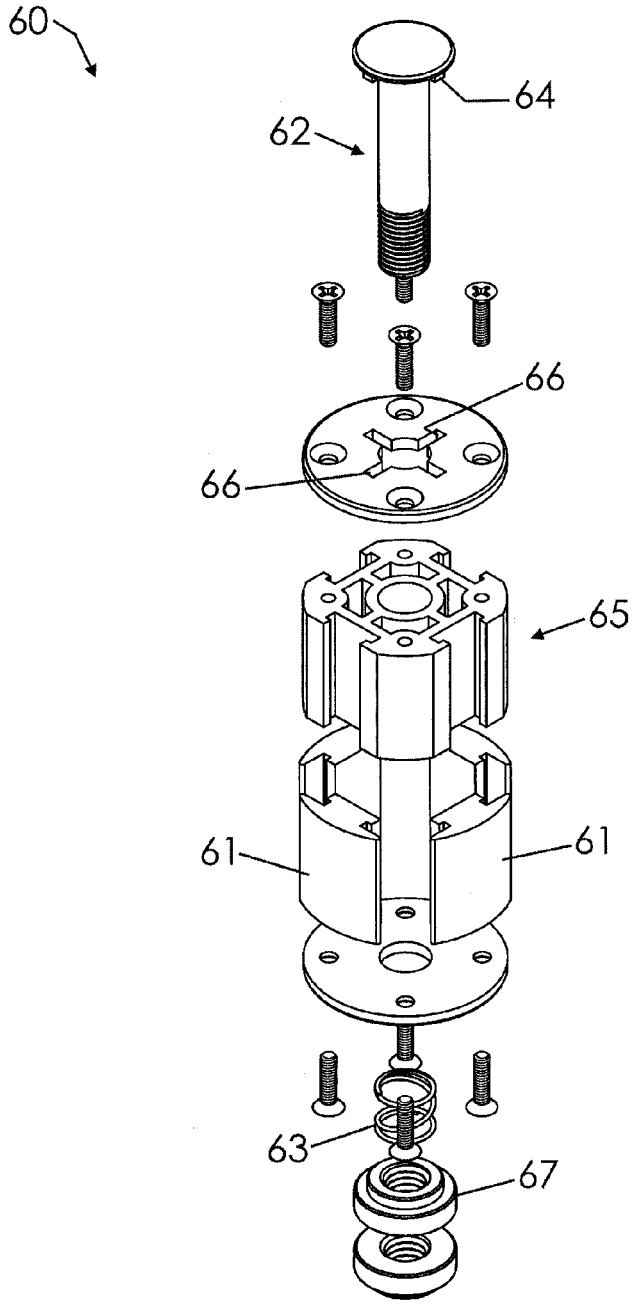
FIG. 6 is an exploded view of the beater head removed from the spindle shaft.

More particularly, FIG. 6 is an exploded view of the beater head 60. A shaft 62 extends through a central bore defined through the body portion 65 and is removably/threadably received in a base 67. Once the shaft 62 is coupled to the base 67, the shaft 62 is fixed from movement and configured such that the body portion 65 can move up and down therealong as described below.

The beater head 60 includes a spring 63 sandwiched between the base 67 and a lower plate of the beater head 60 that is configured to normally bias the body portion 65 in an upwardly extended configuration. However, depressing/actuating the body portion 65 compresses the spring 63 and "unlocks" corresponding shaft flanges 64 from complementary slots 66 defined in an upper plate of the body portion 65 so as to enable the body portion 65—having the beater head surfaces 61—to rotate about the shaft 62. Releasing pressure on the body portion 65 reverses this action and again locks the beater head body portion 65 into place, i.e. corresponding flanges 64 and slots 66 nest together as the spring 63 urges the body portion 65 upwardly. The beater head 60 is not rotatable when the corresponding flanges 64 and slots 66 are engaged/nested.

In one embodiment, the heel driven pedal apparatus 10 includes a spring assembly 40. The spring assembly 40 includes at least one spring member 42 and may also include at least one tension adjustment member 44 coupled to the spring member 42. The spring member 42 may be operatively coupled to the base member 12 and the linkage assembly 30 so as to urge the foot pedal 20 towards the released configuration. As such, the spring member 42 may also urge the beater head 60 away from the percussion instrument.

The linkage assembly 30 may include at least one cam tensioner 32, at least one rocker arm shaft 34, at least one rocker arm 36, and at least one linkage member 38. The cam tensioner 32 may be coupled to the spring assembly 40. The rocker arm shaft 34 may be coupled to the cam tensioner 32 and may also be pivotally coupled to the base member 12. The rocker arm 36 may be coupled to the rocker arm shaft 34 and the proximal end 52 of the spindle shaft 50. The linkage member may be coupled to the rocker arm 36 and the front end 22 of the footboard 20. It is understood that the cam tensioner 32 and spring assembly 40 control the rate and force with which the spindle shaft pivot upon movement of the footboard 20 and cause an automatic movement back to a non-compressed position.

One embodiment of the heel driven pedal apparatus 10 (not shown) may include a pair of spindle shafts 50 and beater heads 60. Respective proximal ends 52 of the spindle shafts 50 are operatively coupled to the linkage assembly 30 so as to move respective beater heads 60 toward one or more percussion instruments when actuated. For instance, the percussion instrument may include a pair of base drums that are played simultaneously by operation of the footboard 20 as described previously or by linking two or more heel driven pedals together as is common with percussion instrument pedals.

In another embodiment (not shown), the linkage assembly 30 may include a cam and cam follower(s) positioned adjacent the rear end 24 of the footboard 20 and be operatively connected to the spindle shaft 50. Accordingly, the spindle shaft 50 and beater head 60 may be controlled by operation of the toe end (rear end) 24 of the footboard 20. Stated another way, the linkage for operating the spindle shaft 50 may be positioned adjacent the rear end 24 of the footboard 20 instead of at the front end 22 as shown in the figures or the linkage may be replaced with a cam and cam follower.

In use, a musician may selectively position his or her foot on the footboard 20 to selectively drive the footboard 20 with either the heel end or the toe end of his or her foot. The footboard 20 may be driven by the heel end of the musician's foot when the toe end of the musician's foot is located forward of the pivot member 15 and the heel end of the musician's foot is located aft of the pivot member 15. Alternatively, the footboard 20 may be driven by the toe end of the musician's foot when the toe end of the musician's foot is located aft of the pivot member 15.

When the musician moves the footboard 20 from the released configuration (FIG. 3) to the compressed configuration (FIG. 2), the linkage assembly 30 and spindle shaft 50 urge the beater head 60 towards the percussion instrument. When the musician removes his or her foot from the footboard 20, the spring member 42 pulls the cam tensioner 32, causing the cam tensioner 32 to rotate the rocker arm shaft 34 relative to the base member 12. As the rocker arm shaft 34 rotates relative to the base member 12, the rocker arm 36 and the spindle shaft 50 move the beater head 60 away from the percussion instrument and the linkage member 38 moves the footboard 20 back to the released configuration.

It is understood that while certain forms of this invention have been illustrated and described, it is not limited thereto except insofar as such limitations are included in the following claims and allowable functional equivalents thereof.

The invention claimed is:

1. A heel driven pedal apparatus for operation by a musician's foot while playing a percussion instrument, said pedal apparatus comprising:

a base member;

a footboard having a front end and an opposed rear end, said footboard being pivotally coupled to said base member with at least one pivot member such that said footboard is pivotally movable between a released configuration at which said rear end of said footboard is displaced from said base member and a compressed configuration at which said rear end of said footboard is adjacent said base member;

a pivoting shaft;

a linkage assembly having a two-ended rocker arm rocking about said pivoting shaft, a first end of said rocker arm being coupled to said front end of said footboard;

a spindle shaft having a proximal end and an opposed distal end, said proximal end being coupled to a second end of said rocker arm of said linkage assembly; and a beater head coupled to said distal end of said spindle shaft;

wherein said linkage assembly and said spindle shaft are configured to move said beater head towards the percussion instrument when said footboard is moved towards the compressed configuration and away from the percussion instrument when said footboard is moved towards the released configuration.

2. The heel driven pedal apparatus of claim 1, wherein said footboard includes opposed first and second side edges extending between said front end and said rear end, said footboard being pivotally coupled to said base member at said first and second side edges of said footboard.

3. The heel driven pedal apparatus of claim 1, further comprising a spring assembly coupled to said base member and said linkage assembly so as to urge said beater head away from the percussion instrument.

4. The heel driven pedal apparatus of claim 3, wherein said spring assembly includes at least one spring member operatively coupled to said base member and said linkage assembly and at least one tension adjustment member coupled to said at least one spring member.

5. The heel driven pedal apparatus of claim 3, wherein said linkage assembly includes:

at least one cam tensioner coupled to said spring assembly;

a rocker arm shaft coupled to said at least one cam tensioner and pivotally coupled to said base member; and a rocker arm coupled to said rocker arm shaft and said spindle shaft.

6. The heel driven pedal apparatus of claim 5, wherein said linkage assembly further includes a linkage member coupled to said rocker arm and said front end of said footboard.

7. The heel driven pedal apparatus of claim 1, wherein said footboard includes a planar surface configured to selectively support the musician's foot between said at least one pivot member and said rear end of said footboard such that said footboard is selectively driven by a toe portion of the musician's foot.

8. The heel driven pedal apparatus of claim 3, wherein said footboard includes a planar surface configured to selectively support the musician's foot between said front and rear ends of said footboard such that the footboard is selectively driven by a heel portion of the musician's foot.

9. The heel driven pedal apparatus of claim 8, further including a toe plate coupled to said front end of said footboard so as to prevent the musician's foot from extending beyond said front end of said footboard.

10. The heel driven pedal apparatus of claim 1, wherein said beater head includes a plurality of spaced apart beater surfaces each configured to produce a respective sound when contacted with the percussion instrument, said beater head being selectively rotatable such that a selected beater surface is selectively positioned relative to the percussion instrument.

11. A heel driven pedal apparatus for operation by a musician's foot while playing a percussion instrument, said pedal apparatus comprising:

a base member;

a footboard having a front end and an opposed rear end, said footboard being pivotally coupled to said base member at a point displaced from both said front end and said rear end such that said footboard is pivotally movable between a released configuration at which said rear end of said footboard is displaced from said base member and a compressed configuration at which said rear end of said footboard is adjacent said base member;

a pivoting shaft;

a linkage assembly having a two-ended rocker arm rocking about said pivoting shaft, a first end of said rocker arm coupled to said front end of said footboard;

a spindle shaft having a proximal end and an opposed distal end, said proximal end being coupled to said linkage assembly to a second end of said rocker arm; and a beater head coupled to said distal end of said spindle shaft;

wherein said linkage assembly is configured to move said spindle shaft and said beater head away from said footboard front end when said footboard is moved toward said compressed configuration and toward said footboard front end when said footboard is moved toward said released configuration.

12. The heel driven pedal apparatus of claim 11, wherein said footboard includes opposed first and second side edges extending between said front end and said rear end, said footboard being pivotally coupled to said base member at said first and second side edges of said footboard.

13. The heel driven pedal apparatus of claim 12, further comprising a spring assembly coupled to said base member and said linkage assembly so as to normally urge said footboard toward said released configuration.

14. The heel driven pedal apparatus of claim 13, wherein the spring assembly includes at least one spring member operatively coupled to said base member and said linkage assembly and at least one tension adjustment member coupled to said at least one spring member.

15. The heel driven pedal apparatus of claim 14, wherein said linkage assembly includes:

at least one cam tensioner coupled to said spring member;

a rocker arm shaft coupled to said at least one cam tensioner and pivotally coupled to said base member; and a rocker arm coupled to said rocker arm shaft and said spindle shaft.

16. The heel driven pedal apparatus of claim 15, wherein said linkage assembly further includes a linkage member coupled to said rocker arm and said front end of said footboard.

17. The heel driven pedal apparatus of claim 16, wherein said footboard includes a planar surface configured to selectively support the musician's foot between said front and rear ends of said footboard such that the footboard may be driven by a heel portion of the musician's foot.

18. The heel driven pedal apparatus of claim 17, further including a toe plate coupled to said front end of said footboard so as to prevent the musician's foot from extending beyond said front end of said footboard.

19. The heel driven pedal apparatus of claim 18, wherein said planar surface of said footboard is configured to selectively support the musician's foot between said at least one pivot member and said rear end of said footboard such that said footboard may be driven by a toe portion of the musician's foot.

20. The heel driven pedal apparatus of claim 19, wherein said beater head includes a plurality of spaced apart beater surfaces each configured to produce a respective sound when contacted with the percussion instrument, said beater head being selectively rotatable such that a selected beater surface is selectively positioned relative to the percussion instrument.

21. The heel driven pedal apparatus of claim 20, wherein said beater head is removably coupled to said spindle shaft.

22. The heel driven pedal apparatus of claim 20, wherein said beater head includes:

a body portion configured to receive said plurality of beater surfaces and defining a central bore;

a shaft extending through said central bore about which said body portion is selectively rotatable and along which said body portion is selectively movable between actuated and released configurations; and a spring in communication with said body portion and normally biased to urge said body portion toward said released configuration;

wherein said beater head body is manually rotatable about said shaft when said body portion is at said actuated configuration.

23. The heel driven pedal apparatus of claim 22, wherein:

said body portion includes an upper plate defining a plurality of slots;

said shaft includes at least one flange configured to selectively nest in a respective slot; and wherein said at least one flange is nested in said respective slot when said body portion is at said released configuration and said at least one flange is displaced from said respective slot when said body portion is at said actuated configuration.

* * * * *